US010335672B1

(12) United States Patent
Devor

(10) Patent No.: US 10,335,672 B1
(45) Date of Patent: Jul. 2, 2019

(54) GAME KIT AND ASSEMBLY

(71) Applicant: Patrick Devor, Austin, TX (US)

(72) Inventor: Patrick Devor, Austin, TX (US)

( * ) Notice: Subject to any disclaimer, the term of this patent is extended or adjusted under 35 U.S.C. 154(b) by 0 days.

(21) Appl. No.: 16/121,705

(22) Filed: Sep. 5, 2018

(51) Int. Cl.
*A63B 67/06* (2006.01)
*A63F 9/02* (2006.01)

(52) U.S. Cl.
CPC ..... *A63F 9/0204* (2013.01); *A63B 67/06* (2013.01); *A63B 2210/50* (2013.01); *A63F 2250/326* (2013.01)

(58) Field of Classification Search
CPC ..... A63B 67/06; A63B 63/00; A63B 2210/50; A63B 71/0036
USPC ..... 273/398–402; 206/742, 751, 752, 754, 206/756, 762, 45.2, 45.23, 45.24
See application file for complete search history.

(56) References Cited

U.S. PATENT DOCUMENTS 406,342 A 7/1889 Dumont
467,964 A 2/1892 Watt
558,100 A * 4/1896 Petereson ..... B65D 5/5266 206/742
569,140 A 10/1896 Nurick
701,658 A 6/1902 Wixcel
731,850 A * 6/1903 Bradbury ..... A63F 9/02 124/7
922,717 A 5/1909 Parker
1,041,496 A * 10/1912 Light ..... B65D 9/34 206/742
1,197,610 A * 9/1916 Darling ..... A45C 9/00 190/16
1,428,226 A * 9/1922 Ganz ..... A47F 5/112 206/45.27
1,461,656 A 7/1923 Harned
1,542,063 A 6/1925 Knight
1,636,920 A 7/1927 Nichols
1,654,556 A * 1/1928 Ryan ..... B65D 5/5206 206/45.26

(Continued)

*Primary Examiner* — Mark S Graham
(74) *Attorney, Agent, or Firm* — C. John Brannon; Brannon Sowers & Cracraft PC

(57) ABSTRACT

A game kit, including a generally rectangular box portion defining a recess, the box portion further including a case portion and a cover portion hingedly connected thereto, a generally flat support member hingedly connected to the case portion, a lockable armature assembly operationally connected to the generally flat support member and to the case portion, a first pipe operationally connected to the cover portion, a pair of ancillary pipes connected to the cover portion, wherein each respective ancillary pipe is positioned opposite the first pipe from the other respective ancillary pipe and wherein each ancillary pipe is equidistant from the first pipe, and a plurality of bean bags. The cover portion is pivotably connected to the case portion and pivotable between a closed position parallel to and engaging the case portion and an open position parallel to and extending away from the case portion. The case portion placed on a generally flat surface, pivoting the first cover portion away from the case portion and into a generally vertical orientation and pivoting the support member away from the case portion and locking the armature assembly deploys the first and ancillary pipes in a generally vertical orientation for receiving tossed bags.

10 Claims, 5 Drawing Sheets

(56) References Cited

U.S. PATENT DOCUMENTS 1,704,531 A * 3/1929 Coombs ..... B65D 5/5253 206/742
1,996,986 A 4/1935 Weinberg
2,224,962 A * 12/1940 Hines ..... A63F 9/0204 273/400
2,455,185 A * 11/1948 May ..... A63B 67/02 473/195
2,549,306 A * 4/1951 Greene ..... A47F 3/145 190/16
2,616,558 A * 11/1952 Kay, Jr. ..... A24F 9/14 131/260
2,827,162 A * 3/1958 Garman ..... B65D 5/52 206/742
3,035,838 A 5/1962 Johnston
3,088,738 A 5/1963 Meyer
3,561,762 A 2/1971 Russell
3,724,617 A * 4/1973 Lawler ..... A45C 5/14 190/1
4,243,229 A 1/1981 Huser et al.
4,326,722 A * 4/1982 Dickens ..... A63F 9/0204 273/400
4,982,966 A 1/1991 Teafatiller
5,021,527 A 6/1991 Ohmori et al.
5,050,889 A 9/1991 Walker
5,201,527 A * 4/1993 Koket ..... A63B 71/0036 273/402
5,332,230 A 7/1994 Benedict
5,788,242 A 8/1998 Rudell et al.
7,325,682 B2 2/2008 Seymour et al.
7,500,674 B2 3/2009 Riley et al.
7,607,666 B1 10/2009 Studier
8,235,880 B2 8/2012 Guier
8,651,492 B1 2/2014 Cappuccio
8,950,658 B2 * 2/2015 Aldridge ..... B65D 5/18 206/38
9,623,307 B1 * 4/2017 Devor ..... A63B 67/06
2008/0111312 A1 * 5/2008 Longo ..... A63B 67/06 273/402
2012/0169012 A1 7/2012 Parker et al.
2014/0265136 A1 9/2014 Parker et al.
2015/0069708 A1 3/2015 Mashburn

* cited by examiner

GAME KIT AND ASSEMBLY

BACKGROUND

It is important to learn basic concepts such as motor coordination, simple spatial relationships, how to follow simple directions, and how to deal with setbacks in a mature and sportsmanlike manner. As these simple skills are mastered, more complex skills may be acquired, such as how to plan competitive strategies and how to take advantage of opportunities as they present themselves.

One way of acquiring such basic skills is through the playing of educational games that make the learning process fun and entertaining. While many such games have been developed, none effectively combine the teaching of colors, spatial relationships, and strategy with simple, easy to comprehend instructions and a unitary, easy to set up, integrated carrying case kit. Hence, there is a need for an improved educational, portable game capable of teaching colors, spatial relationships, strategy and sportsmanship and of being easily understood and played by anyone, including young children. A means for satisfying this need has so far eluded those skilled in the art.

DETAILED DESCRIPTION

Figure 1:
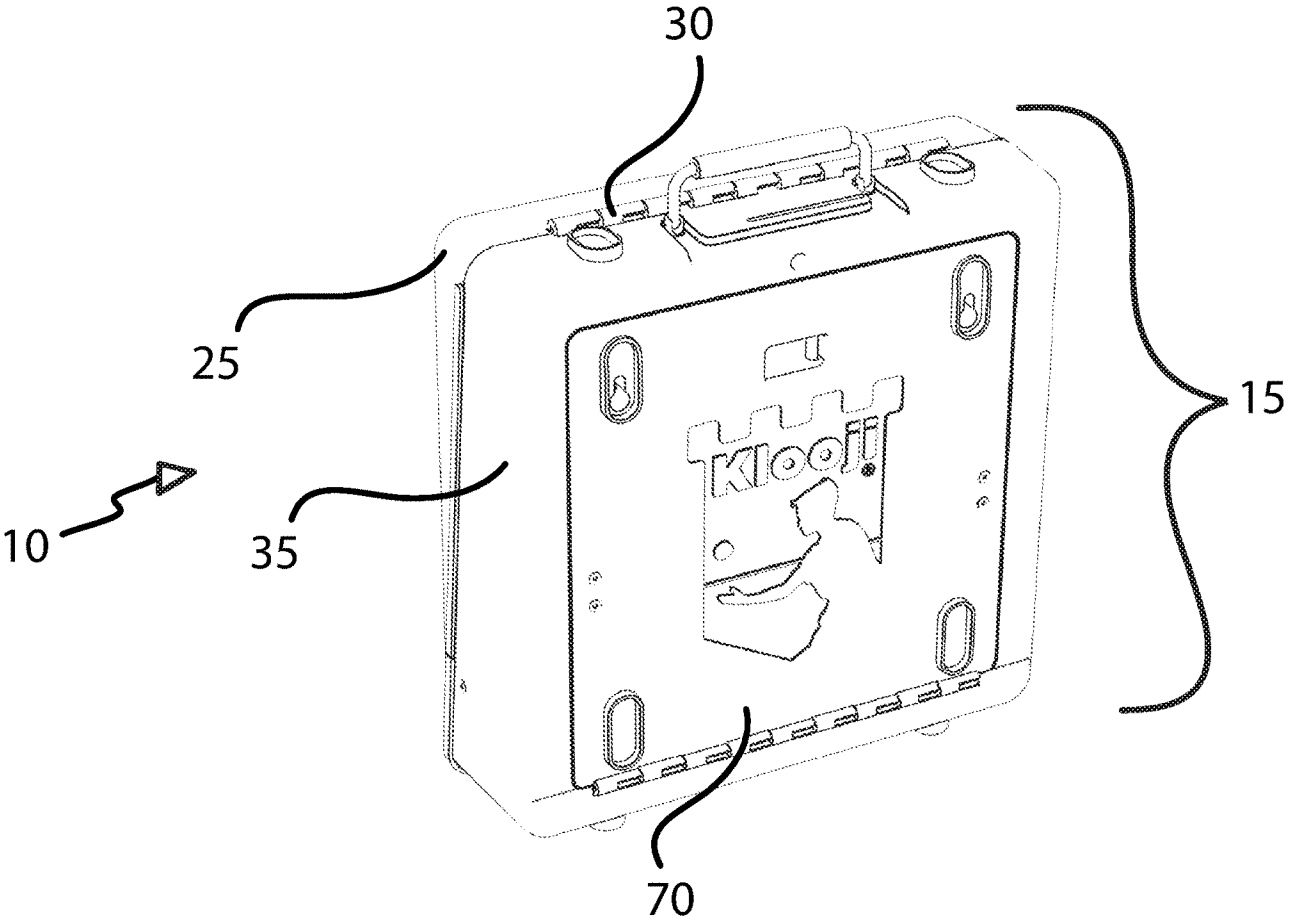
FIG. 1 is a perspective view of a first embodiment game system of the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Figure 2:
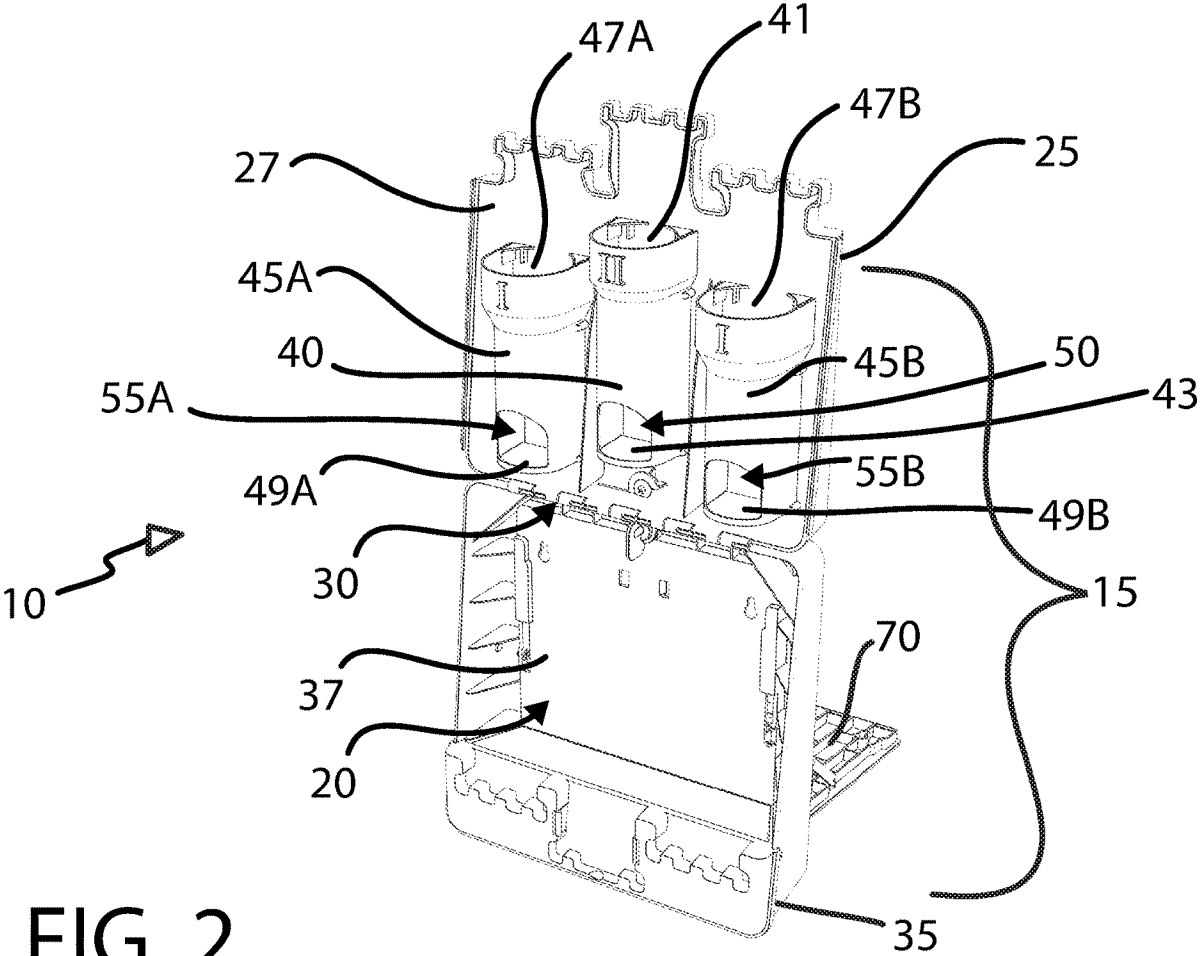
FIG. 2 is a second perspective view of the system of FIG. 1 with game case open and support member deployed.
Figure 3:
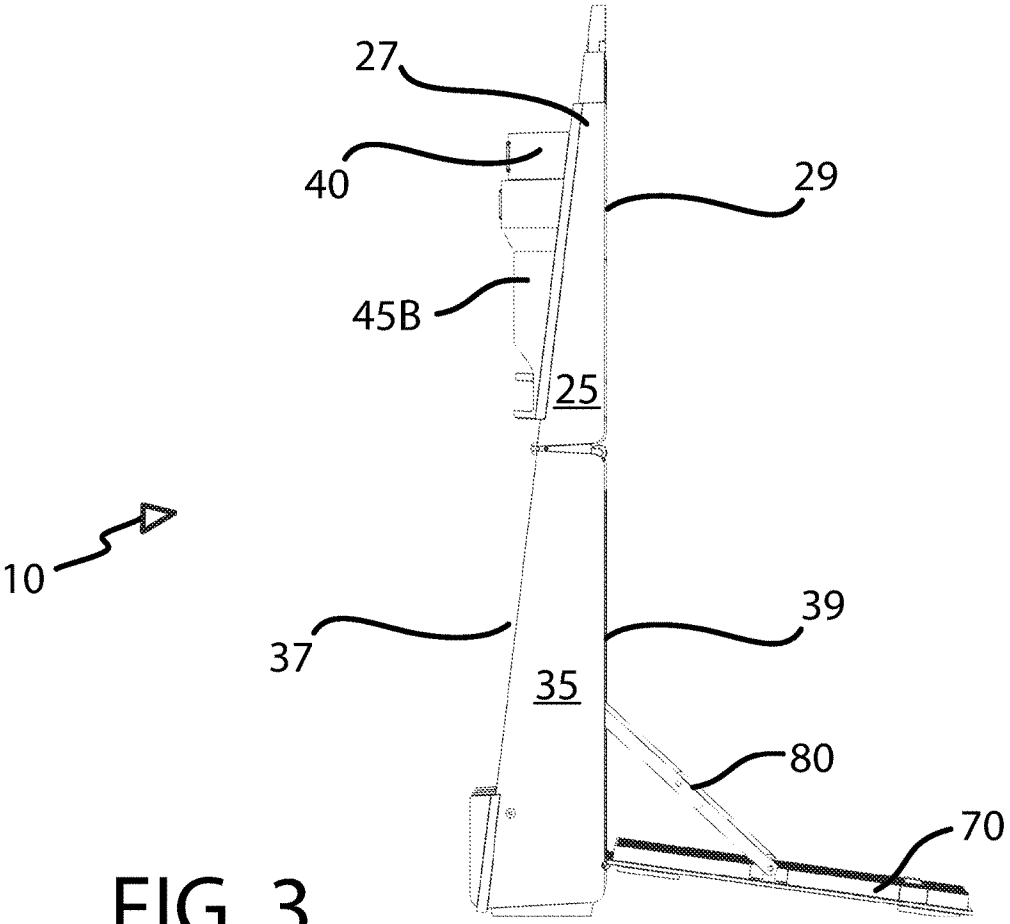
FIG. 3 is a side elevation view of the system of FIG. 2.
Figure 4:
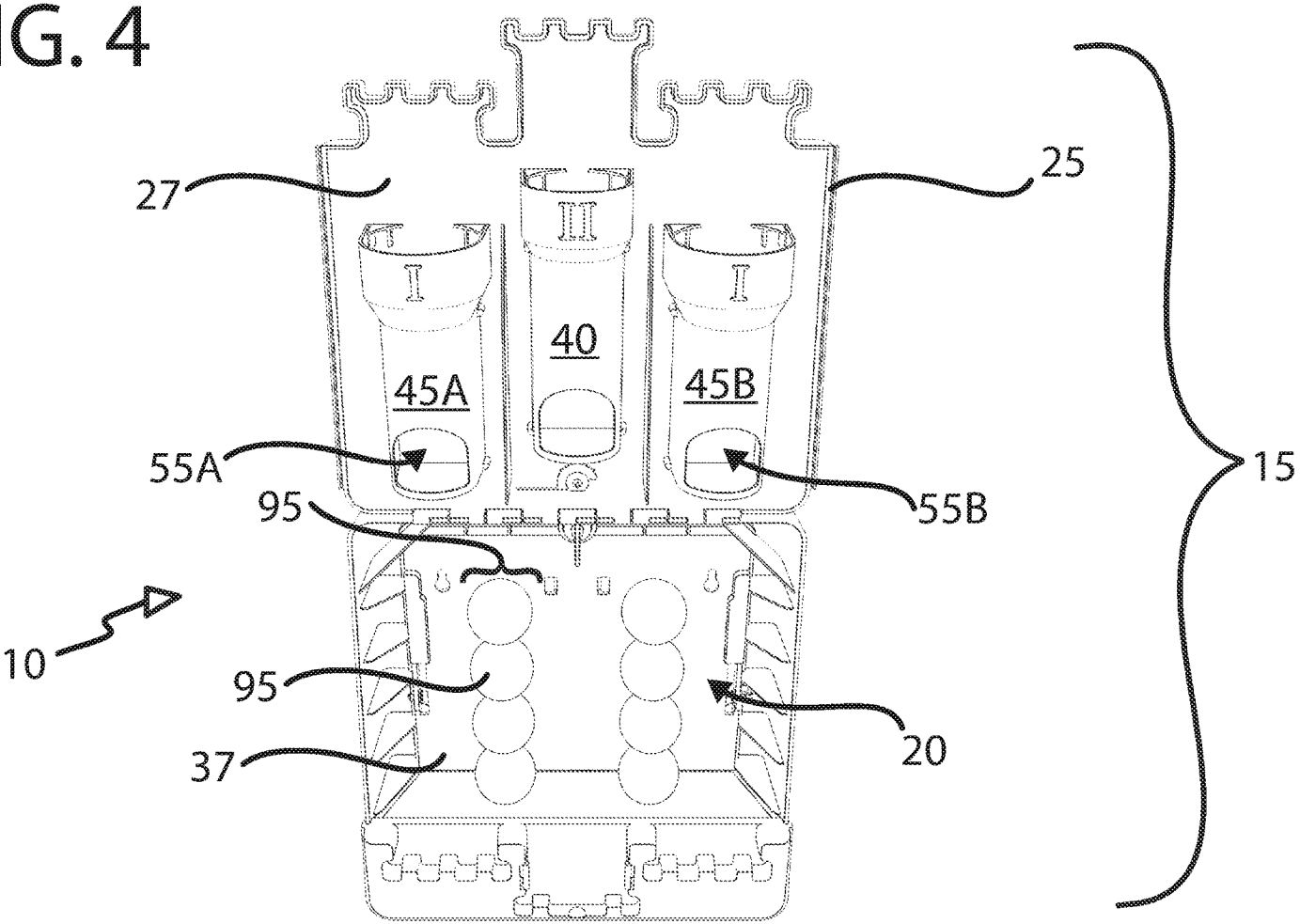
FIG. 4 is a front elevation view of FIG. 3.
Figure 5:
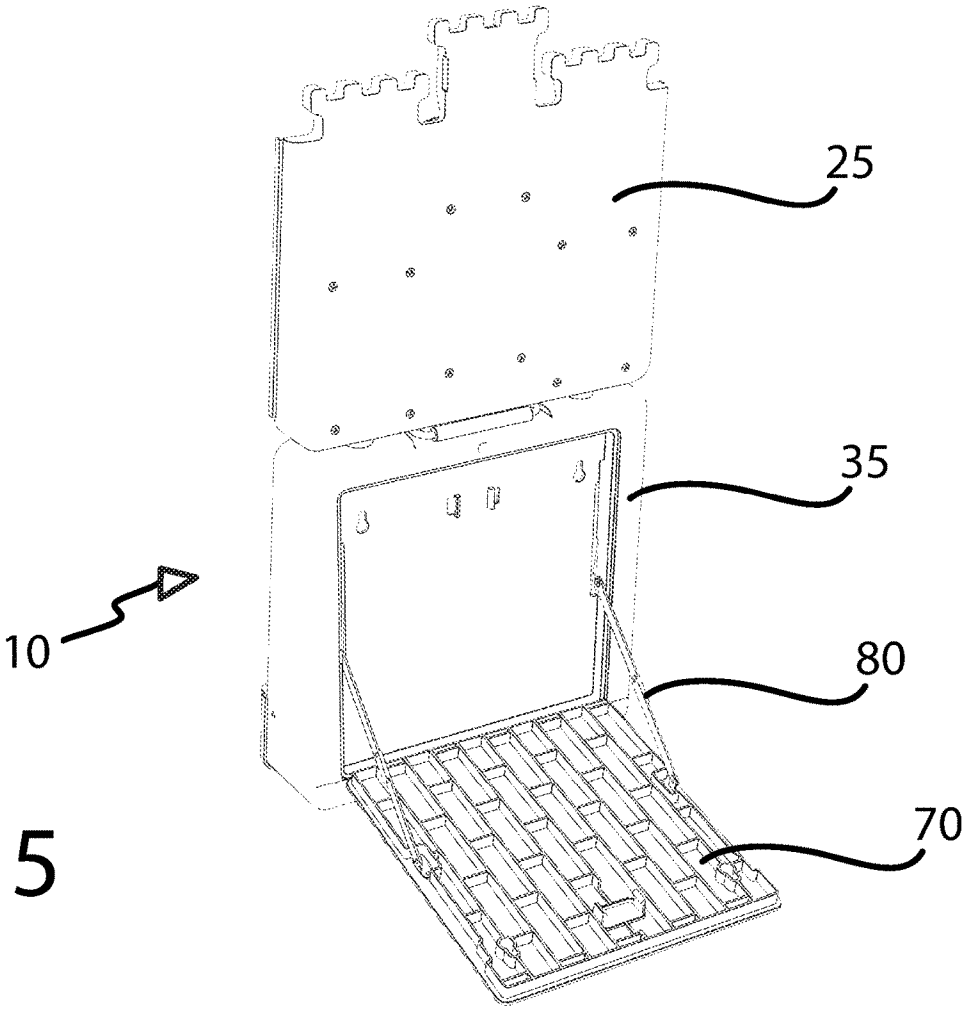
FIG. 5 is a rear perspective view of the system of FIG. 2.

FIGS. 1-5 illustrate a first embodiment of the present invention. A game kit 10 is shown consisting of a shallow, typically rectangular, elongated carrying case or box 15 defining a recess 20 and having a cover portion 25 pivotably connected via hinge assembly 30 to a base or case portion 35. Cover member 25 defines inner surface 27 and opposite outer surface 29 and case portion 35 defines inner surface 37 and oppositely disposed outer surface 39, with respective inner surfaces 27, 39 disposed toward recess 20 when cover and case portions 25, 35 are pivoted towards one another, and away from outer surfaces 29, 39 when pivoted away from one another; inner surfaces 27, 37 are oriented substantially parallel to one another and disposed facing away from outer surfaces 29, 39 when oriented for game play.

Central 40 and ancillary 45A, 45B pipes are connected to inner surface 27 of cover portion 25. Central pipe 40 is typically positioned between ancillary pipes 45A, 45B, and is more typically positioned equidistant to pipe 45A and pipe 45B. Central pipe 40 top opening 41 defines a diameter that is typically smaller than the diameter defined by top openings 47A, 47B of ancillary pipes 45A, 45B, and the top openings 47A, 47B of ancillary pipes 45A, 45B are typically of the same diameter. Pipes 40, 45A, 45B are typically generally cylindrical and include respective openings 41, 47A, 47B at one end and are closed by panels 50 at the respective opposite ends. Pipes 40, 45A, 45B typically have respective openings 50, 55A, 55B formed therethrough and are typically positioned adjacent the respective bottom panels 43, 49A, 49B.

Pipe openings 41, 47A, 47B may be made larger or smaller, such as by inserting aperture flanges or the like to narrow the openings 41, 47A, 47B or by attaching conical or frustoconical segments to effectively enlarge the openings 41, 47A, 47B, so as vary the difficulty level of play.

Cover portion 25 typically closingly engages base portion 35 when pivoted towards base portion 35 such that inner surfaces 27, 37 face one another to define recess 20. When engaged with one another, cover and case portions 25, 35 define recess 20 wherein pipe members 40, 45A, 45B are enclosed. Cover portion 25 may be pivoted to engage case portion 35 for storage and away from case portion 35 and locked for deployment in a generally upright orientation (i.e., cover and case portions 25, 35 are positioned generally parallel one another with inner surfaces 27, 37 facing the same direction and extending generally perpendicularly to the ground or a floor upon which case portion 35 rests) for game play. Support member 70 is pivotably, and more typically hingedly, connected to outer surface 39; hinged panel 70 may be pivoted away from case member 35 and locked into place to function as a support member to maintain upright orientation of the case and cover members 35, 25. In some embodiments, a lockable armature assembly 80 is operationally connected to the panel 70 and to the case member 35.

Box 15 is typically formed from a rigid, structural material, such as wood, plastic, sheet metal, or the like.

Game kit 10 further includes one or more sets or pluralities 90 of (typically colored) tossing objects or bean bags 95. Typically, each set includes at least two, and more typically three, four or more bags 95 and is characterized by a unique color component and heft. Tossing objects 95 are typically stored in recess 20 when not currently in play.

Methods of Play

In the above-described preferred embodiment, the game can be played by any number of players, typically two, three or four players. A player can be either an individual or a team. Each player chooses a side, left or right, to target. The order of play is determined by any convenient means, such as a coin toss or like means to determine which player (here represented by a color for the purpose of determining play order) goes first. Players are positioned, when it is their turn, to stand a predetermined distance from the pipes 40, 45A, 45B; typically, all players are positioned the same predetermined distance from the pipes on their turn, but players may be handicapped greater or lesser distances, depending on such factors as relative talent, previous success, penalties or rewards imposed, or the like. Each player takes a turn by attempting to toss a bag 95 into a pipe 40, 45A, 45B, either the ancillary pipe 45A, 45B residing on the player's predetermined side or the central pipe 40. Typically, the opening 41 of the central pipe 40 has a smaller diameter than the other openings 47A, 47B, and thus tossing a bag 95 into the central pipe 40 is more difficult and thus worth more points.

Typically, one point is scored for each bag tossed into an ancillary pipe 45A, 45B, while two points are scored for tossing a bag into the central pipe 40, although other point values may be assigned. In some versions of play, additional points may be wagered or awarded, such as for especially difficult tosses. In other versions, points may be deducted for missing. In still other versions of play, the opposing player(s) may be awarded points if a player tosses his bag 95 into the ancillary pipe 45A, 45B residing on the side opposite that to which he is assigned.

In some versions of play, each player takes a single toss on his turn, and the turn then passes to the next player. In other versions of play, each player continues tossing bags until he misses. The game is won by the first player to reach an arbitrary goal, such as fifteen points.

Of course, all of these rules and variations are merely suggestions. Many variations of the method of play using the game kit 1*o*, pipes 40, 45A, 45B and bags sets 90 are possible and will become apparent to those using the invention, particularly parents and teachers practicing the invention as a teaching tool.

EXAMPLE

The game kit 10 as described above may be played according to the following rules and specifications.

Rule 1—Playing Area:

Section A. Dimensions-A playing area should be a level playing area, such as grass, carpet, concrete surface, or the like. The playing area consists of one Klooji game, and a foul line, located 12 feet from the front of the game pipes. If a measuring device is not present to determine 12 feet, 5 large strides from the front of the game can dictate the foul line if agreed upon by both players.

Section B. Foul line—A player must stand shoulder to shoulder with other player and toss from behind the foul line. Each player must be no farther than 5 feet apart from one another.

Section C. Players—2 players or 2 teams of 2 players each may be used. In the event a player or team may want to use 2 Klooji games to avoid walking back and forth after tossing, the $2^{nd}$ game should be placed staggered, not directly across from the foul line.

Rule 2—Playing Equipment

Section A. The following equipment specifications and standards are necessary for the game of Klooji:

1) Each Klooji game kit should be approximately 37"H× 17" W×6" deep and constructed of ½" pvc plastic, wood, or equivalently rigid material.
2) Each Klooji game consists of 3 pipes attached vertically to the pivoting backboard of the Klooji game.
   a. Each pipe is approximately 10" in length.
   b. The side pipes top internal diameter opening is 4.25".
   c. The center pipe internal diameter is 3.75".
   d. From the ground to the top of the 2 side pipes is a minimum of 30".
   e. The center pipe height is 32" from the ground.
   f. The distance between openings at the top of the pipes should be 1" to allow for "Klingers" (bag is stuck between pipes)
   g. The backboard height is a maximum of 37" from ground to the highest point. This allows for "banking" a bag off of the backboard to fall into the pipe.
   h. The backboard must be at 90 degrees to the ground surface
   i. Each pipe must have the capacity to retain a minimum of 8 Klooji bags
   j. Each pipe has an opening on the bottom front face to allow for removal of Klooji bags after each round
3) The Klooji bags shall be made from synthetic suede material, with 2 panels, filled with plastic granules, 7 cm in diameter, and not to exceed 85 grams in weight. Each player will use 4 bags of the same pattern or color during play.

Rule 3—Throwing Distance

Section A. Adults—all adult contestants must stand a minimum of 12 feet from the backboard when positioned vertically. Each player must be no farther than 5 feet apart while throwing.

Section B. Children (under 12 years of age) may select any distance agreeable to throw from.

Rule 4—Play of the Game

Section A. Singles or Doubles Play—Klooji can be played as doubles or singles. In doubles play 2 contestants are partners against another team of 2 players. In singles, one contestant competes against another contestant. One game board or 2 may be used. But, it is not necessary to have 2 Klooji games to play doubles.

Section B. Rounds—every Klooji contest is broken down into rounds of play. During each round, each contestant must throw all 4 of their bags, in alternating tosses between competitors.

Rule 5—Scoring

Section A. Net gain Scoring—Each Klooji player is assigned their own side pipe, the player on the right of the other player accumulates points in the right side pipe and middle pipe. The player on the left side accumulates points in the left pipe and middle pipe. Only one player can score per round. If player A totals 5 points and player B totals 3 points, player A is awarded the NET GAIN of 2 points for that round.

Section B. Scoring in wrong pipe—If a Klooji player tosses his bag accidentally into his opponent's side pipe, the opponent adds that 1 point to his score. The middle pipe is always worth 2 points and the side pipes are worth 1.

Section C. Klingers and missed throws: If a Klooji player's bag is lodged between pipes (called a Klinger) or is hanging on the pipe opening, no point is scored. The bag must be 51% inside the pipe cylinder to score a point. A player with 2 Klingers in the same round is awarded the title of Klinger King for the round, but no points are assigned.

Section D. Winning the Game: Each player alternates tosses and adds to each rounds score with the net gain from the prior round. The winner is the $1^{st}$ Klooji player to reach 15 points or the highest score of the last round where 15 is reached. Ie. If the last round, player A has 16 and player B has 17, player B is the winner. It is not required to land on 15, or to win by 2 points.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A game kit, comprising:

a generally rectangular box portion defining a recess, wherein the box portion further comprises a case portion and a cover portion hingedly connected thereto;

a generally flat support member hingedly connected to the case portion;

a lockable armature assembly operationally connected to the generally flat support member and to the case portion;

a first pipe operationally connected to the cover portion;

a pair of ancillary pipes connected to the cover portion, wherein each respective ancillary pipe is positioned opposite the first pipe from the other respective ancillary pipe and wherein each ancillary pipe is equidistant from the first pipe; and a plurality of bean bags;

wherein the cover portion is pivotably connected to the case portion and pivotable between a closed position parallel to and engaging the case portion and an open position parallel to and extending away from the case portion;

wherein with the case portion placed on a generally flat surface, pivoting the first cover portion away from the case portion and into a generally vertical orientation and pivoting the support member away from the case portion and locking the armature assembly deploys the first and ancillary pipes in a generally vertical orientation for receiving tossed bags.

2. The game system of claim 1 wherein the first pipe has a smaller diameter opening than the ancillary pipes.

3. The game system of claim 1 wherein the plurality of bags includes bags of a first color and bags of a second color.

4. A method of playing a game comprising the steps of:

a) providing a game system, said same system including a recessed base portion, a first support member pivotably connected to the recessed base portion, a cover portion pivotably connected to the base portion, a plurality of hollow pipes mounted to the cover portion, and a plurality of bean bags;

b) moving the base portion into a generally vertical orientation;

c) pivoting the support member away from the base portion to support the base portion's generally vertical orientation;

d) pivoting the cover portion away from the base portion and into a generally vertical orientation to expose a plurality of pipes in a generally vertical orientation;

e) providing a plurality of players;

f) defining a throw line;

g) assigning each player one or more respective hollow pipes;

h) assigning point values to each respective hollow pipe;

i) taking turns tossing bags from the throw line to be received in one or more respective assigned hollow pipes;

j) scoring for each successful toss; and k) declaring the first player to reach a predetermined point sum the "winner".

5. The method of claim 4 and further comprising:

l) after k), placing the plurality of bags into the base portion;

m) after l), pivoting the support member toward the cover member and engaging the same thereto; and n) after m), pivoting the cover portion toward and into engagement with the base portion.

6. The method of claim 4 wherein each respective hollow pipe includes a generally circular opening having a respective opening diameter.

7. The method of claim 6 wherein the plurality of hollow pipes includes a central hollow pipe and two flanking hollow pipes; and wherein the central pipe has a different opening diameter than the flanking hollow pipes.

8. The method of claim 7 wherein the central hollow pipe has a smaller opening diameter than the flanking hollow pipes.

9. A game system, comprising:

a base portion defining a recess and having an inner base surface and an outer base surface;

a cover portion pivotably connected to the base portion, wherein the cover portion has an inner cover surface and an outer cover surface;

a support member pivotably connected to the base portion;

a first generally hollow elongated member operationally connected to the inner cover surface;

a second generally hollow elongated member operationally connected to the inner cover surface and oriented parallel to the first generally hollow elongated member;

a third generally hollow elongated member operationally connected to the inner cover surface and oriented parallel to the first generally hollow elongated member, wherein the second and third generally hollow elongated members are positioned on opposite sides of the first generally hollow elongated member; and a plurality of throwing objects;

wherein the support member is lockable when pivoted away from the base portion to prevent the support member from pivoting; and wherein with the base portion placed on a generally flat surface, pivoting the cover portion away from the base portion such that the base inner surface and the cover inner surface are parallel and facing away from the base outer surface, and pivoting the support member away from the base portion, deploys the respective elongated hollow members for receiving tossed throwing objects;

wherein the throwing objects are bean bags.

10. The game system of claim 9 and further including at least one insert for placing in a respective generally hollow elongated member to increase the opening area of the generally hollow elongated member.

* * * * *